United States Patent [19]

Smith et al.

[11] Patent Number: 4,591,147

[45] Date of Patent: May 27, 1986

[54] SYSTEM FOR ELEVATING AN EXERCISE TREADMILL

[75] Inventors: David B. Smith, Mercer Island; John M. Moore, Woodinville, both of Wash.

[73] Assignee: Precor Incorporated, Redmond, Wash.

[21] Appl. No.: 647,548

[22] Filed: Sep. 6, 1984

[51] Int. Cl.[4] ..... A63B 23/06

[52] U.S. Cl. ..... 272/69; 272/130

[58] Field of Search ..... 272/69, 70, 97, 130; 254/93 R; 248/162.1

[56] References Cited

U.S. PATENT DOCUMENTS

| | | | |
|---|---|---|---|
| D. 211,801 | 7/1968 | Quinton | D34/5 |
| D. 270,555 | 11/1983 | Ogden | D21/192 |
| D. 273,029 | 3/1984 | Kullenberg | D21/192 |
| 3,190,614 | 6/1965 | Evers et al. | 254/93 |
| 3,643,943 | 2/1972 | Erwin, Jr. et al. | 272/69 |
| 4,423,864 | 1/1984 | Wiik | 272/69 X |

FOREIGN PATENT DOCUMENTS

| | | | |
|---|---|---|---|
| 8201138 | 4/1982 | World Int'l Prop. O. | 272/69 |

OTHER PUBLICATIONS

"The Puch Jogger", Steyr-Daimler-Puch (GB) Ltd., 7/1977.

Portions of Burdick Corporation advertising brochure illustrating Models TMS-300 and TMS-400 Treadmills.

Advertising sheet illustrating the ICR Whispermill Model Treadmill distributed by Instruments for Cardiac Research, Inc.

Portions of advertising brochure distributed by Haden Industries, Inc. illustrating the Woodway Treadmill.

Portions of advertising brochure distributed by Kidde, Inc. illustrating treadmills marketed under the designations TREDEX Nos. 2902, 2903, 2904, 2905, and 2921.

Portions of advertising brochure distributed by Fitness Equipment illustrating treadmills marketed under designations Marathon 1000, 3000, 5000, 5000E and 7000.

Portions of advertising brochure distributed by MacLevy Products, Corp. illustrating treadmills "Jog Master, Jog-O-Matic, Cardio Fitness, and Tunturi."

Advertising sheet distributed by MGI Strength/Fitness Systems illustrating treadmill Models 23N and 23P.

Advertising brochure distributed by Marquette Electronics, Inc. illustrating the Series 6500 Modular Exercise System.

Portions of advertising brochures illustrating treadmills marketed by M & R Industries, Inc. under the designation Delo Treadmill.

Advertising brochure illustrating the TM Pacer II Treadmill marketed by Ogden Health Products.

Portions of advertising brochure distributed by Pacer Industries, Inc. illustrating treadmill Models R1, R2, R2D, R3, R3 Digital, R9 and R9 Clinical.

Portions of advertising brochure distributed by Trotter Treadmills, Inc. illustrating treadmill Model C22, Trotter 320 and Trotter 3100.

Portions of advertising sheets distributed by Quinton Instrument Company illustrating treadmill Models 18-49, 18-60, 24-72 and 18-54.

*Primary Examiner*—Richard J. Apley

*Assistant Examiner*—Robert W. Bahr

*Attorney, Agent, or Firm*—Christensen, O'Connor, Johnson & Kindness

[57] ABSTRACT

A system for selectively positioning one end of a treadmill running machine at one of the plurality of locked positions in order to provide an inclined running surface. A support assembly having a ground engaging roller disposed between a pair of arms is pivotally connected to the frame of the treadmill for swinging movement between a retracted position adjacent the frame and one of a plurality of downward, extended positions. So that the treadmill may be easily raised and lowered to a desired operating position, a gas spring is provided for each of the arms of the support assembly. The upper end of each gas spring is securely connected to the frame, while the lower end is pivotally attached to its respective arm. To maintain the support assembly in one of its extended positions, a slide-tube assembly having a releasable clamping sleeve is associated with each of the arms and pivotally connected to the frame and arm to accommodate the swinging movement of the support assembly.

9 Claims, 5 Drawing Figures

SYSTEM FOR ELEVATING AN EXERCISE TREADMILL

TECHNICAL FIELD

The present invention relates generally to exercise equipment. More particularly, the invention concerns a system for selectively elevating and locking one end of a treadmill running machine at one of a plurality of positions in order to provide an inclined running surface.

BACKGROUND OF THE INVENTION

With the current interest in physical fitness, exercise equipment is enjoying widespread popularity and commercial success. One such type of equipment is the exercise treadmill that, in its simplest form, includes an endless belt that is moved over an underlying track by a walker or runner. Consistent with the advances in electronics, many of these running machines are motor-driven and include microcomputers that control the drive motor, monitor an individual's workout and provide an output display indicating various conditions such as time, speed, and distance.

It is well known that the amount of exertion required to maintain pace with the exercise treadmill can be increased by inclining the running surface so that the runner runs up a grade. Also, inclining the treadmill track can provide the desired level of exertion for patients that are recovering from a cardiac illness and thus use the treadmill as a walking apparatus.

Various mechanisms that raise the front end of the exercise treadmill relative to the floor or other support surface upon which the machine is positioned have been employed to provide an inclined running surface. These mechanisms, however, have not proven to be entirely satisfactory. In particular, because of the weight of the treadmill, such devices are often difficult to operate and adjust properly at the desired height, especially for older persons or those undergoing physical therapy.

The present invention overcomes the disadvantages of these prior developments. In particular, an important aspect of the invention is the provision of a treadmill elevation system in which a gas spring is utilized to provide a substantially "zero-bias" so that the treadmill may be easily raised and lowered to a desired operating position.

SUMMARY OF THE INVENTION

In accordance with the invention, a system for elevating an exercise treadmill includes a support assembly having a roller mounted between the lower ends of a pair of arms. The upper ends of the arms are pivotally connected to the frame of the treadmill so that the support assembly may be swung between a retracted position adjacent the frame and one of a plurality of downward, extended positions. To provide forces that assist in raising and lowering the treadmill, a gas spring is provided for each of the arms of the support assembly. The upper end of each gas spring is pivotally connected to the frame, while the lower end is pivotally attached to its respective arm. In this manner, a substantially constant, linear force is provided between the frame and the support assembly during the entire stroke of the gas spring and thus the travel of the support arms.

In a further aspect of the present invention, releasable locking means are included for selectively maintaining the support assembly in one of its plurality of extended positions. In preferred form, the releasable locking means comprise a pair of slide-tube assemblies, one of the assemblies controlling the positioning of each of the arms of the support assembly. Each slide-tube assembly has a collar that is pivotally connected to its associated arm by the same pin that provides pivotal connection between the gas spring and arm. A slide-tube is connected at its lower end to the collar and selectively held at positions along its length by a clamping sleeve. The clamping sleeve is, in turn, pivotally connected to the frame so that the slide-tube may both slide relative to the clamping sleeve and rotate through an arcuate path of travel to accommodate the swinging movement of the support assembly. In preferred form, the clamping sleeve is connected to the frame by a pivot bolt that has a manually actuatable nut on its threaded end. In operation, when a desired height is attained, hand tightening of the nut causes the clamping sleeve to securely hold the slide-tube which, in turn, prevents further relative movement between the frame and the support assembly.

BREIF DESCRIPTION OF THE DRAWINGS

The invention can be understood by the following portion of the specification taken in conjunction with the accompanying drawings in which.

DESCRIPTION OF THE INVENTION

Figure 1:
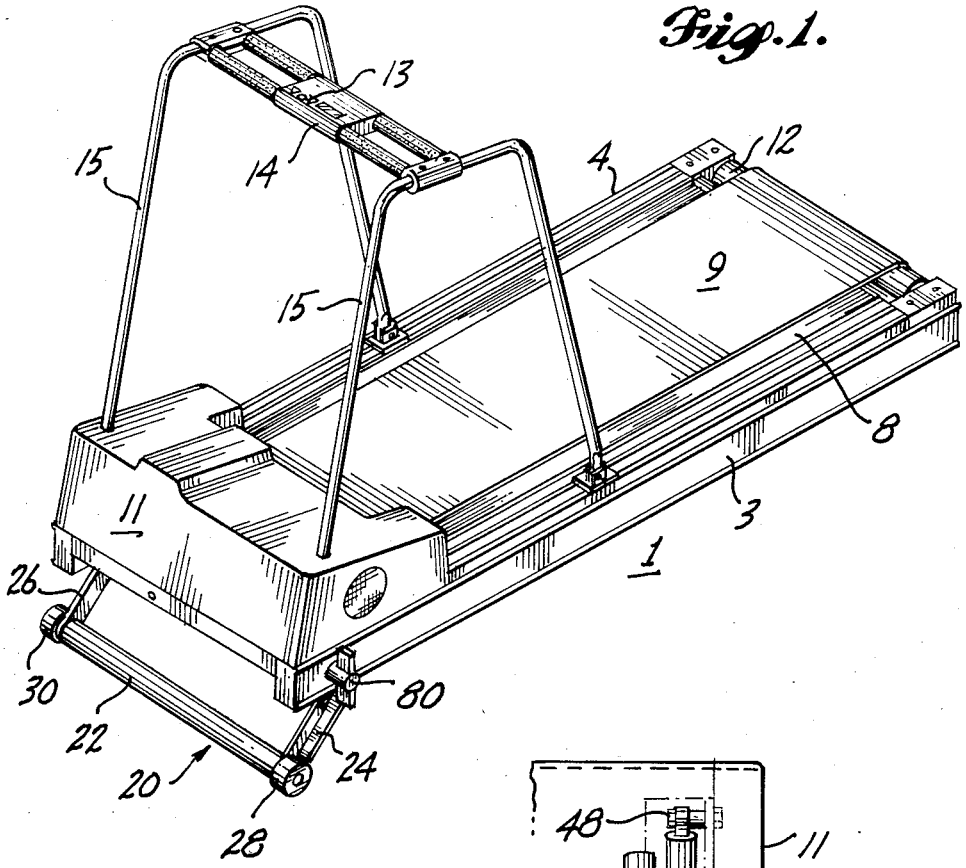
FIG. 1 is a perspective view of an exercise treadmill having its forward end supported upwardly off the floor with an elevation system of the present invention.
Figure 2:
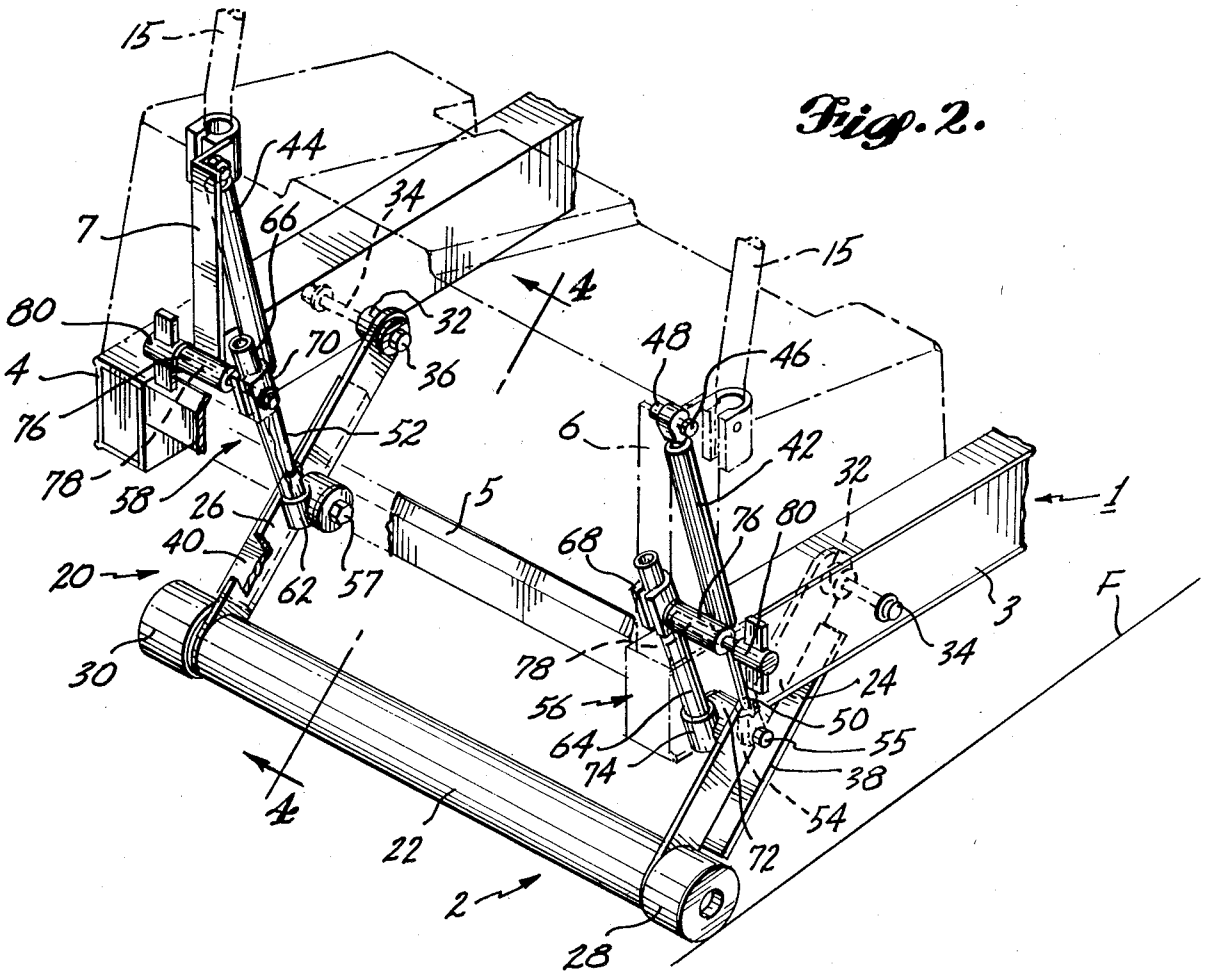
FIG. 2 is an enlarged perspective view of the elevating system shown in FIG. 1, portions of which are shown in phantom line.

Referring initially to FIGS. 1 and 2, the forward end of an exercise treadmill 1 is supported upwardly off the floor F by an elevating system 2 of the present invention. The exercise treadmill is constructed with a frame composed of a pair of elongate, hollow, box beam side rails 3 and 4, rigidly interconnected by a plurality of cross members 5. L-shaped posts 6 and 7, FIG. 2, are secured at their lower ends to the forward end portions of side rails 3 and 4, respectively, extending upwardly therefrom at generally right angles. These particular components of the frame are preferably of light weight and durable material, such as anodized aluminum, and are joined together by welding.

A flat bed 8 extends along the length of the exercise treadmill frame between side rails 3 and 4. The bed is supported by upper edge portions of the side rails. The upper run of an endless belt 9 rides over bed 8 and is supported thereby. Belt 9 is driven by a driving roller 10 which in turn is powered by an electric motor, not shown, housed within cover 11 at the front of exercise treadmill 1. At the end opposite to driving roller 10, the endless belt rides around an idler roller 12 that spans between and is supported by the rearward ends of frame side rails 3 and 4. The speed of belt 9 is selectively controlled by appropriate electronic control devices mounted beneath a panel 14 that spans between tubular hand rails 15 extending upwardly from frame side rails 3 and 4. A plurality of manually operable control switches 13 are located on panel 14.

Next referring specifically to FIG. 2, the elevating system 2 includes a support assembly generally designated 20 having an elongate roller 22 mounted between the lower ends of a pair of elongate arms 24 and 26. A pair of side rollers 28 and 30 are mounted in opposition to one another adjacent the outer side faces of the arms 24 and 26, respectively. To mount the elongate roller 22 and the side rollers 28 and 30, the roller 22 includes a central axle that extends through close-fitting clearance openings formed in the ends of the arms 24 and 26 and through centrally located bores in the side rollers 28 and 30. Threaded ends of the axle receive nuts, not shown, disposed within counterbores formed within rollers 28 and 30 to hold these rollers together with roller 22 securely in place and to rigidly join the arms 24 and 26 for cooperative swinging movement to elevate and lower the exercise treadmill 1.

Figure 5:
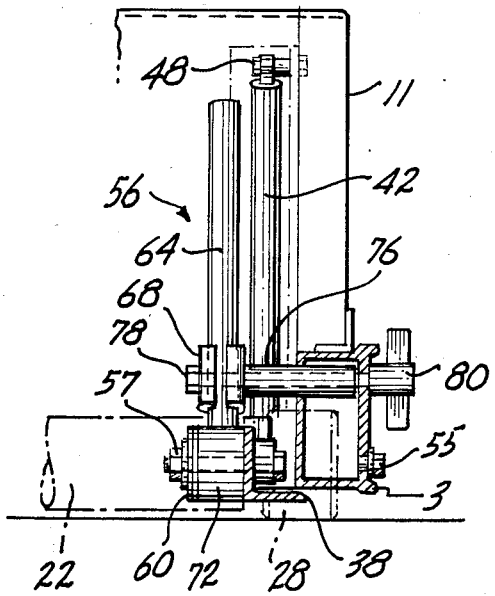
FIG. 5 is a fragmentary front elevation view taken along lines 5—5 of FIG. 3, but illustrating the opposite side of the elevating system shown in FIG. 3.
Figure 3:
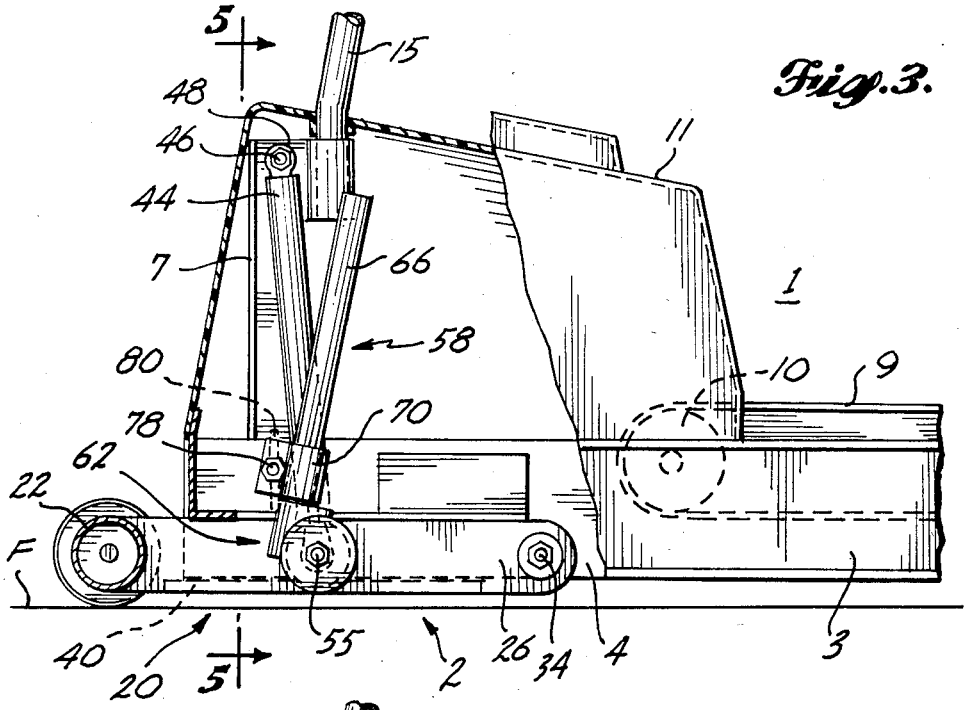
FIG. 3 is a side view, with parts broken, of the system of FIG. 2 in its retracted position.
Figure 4:
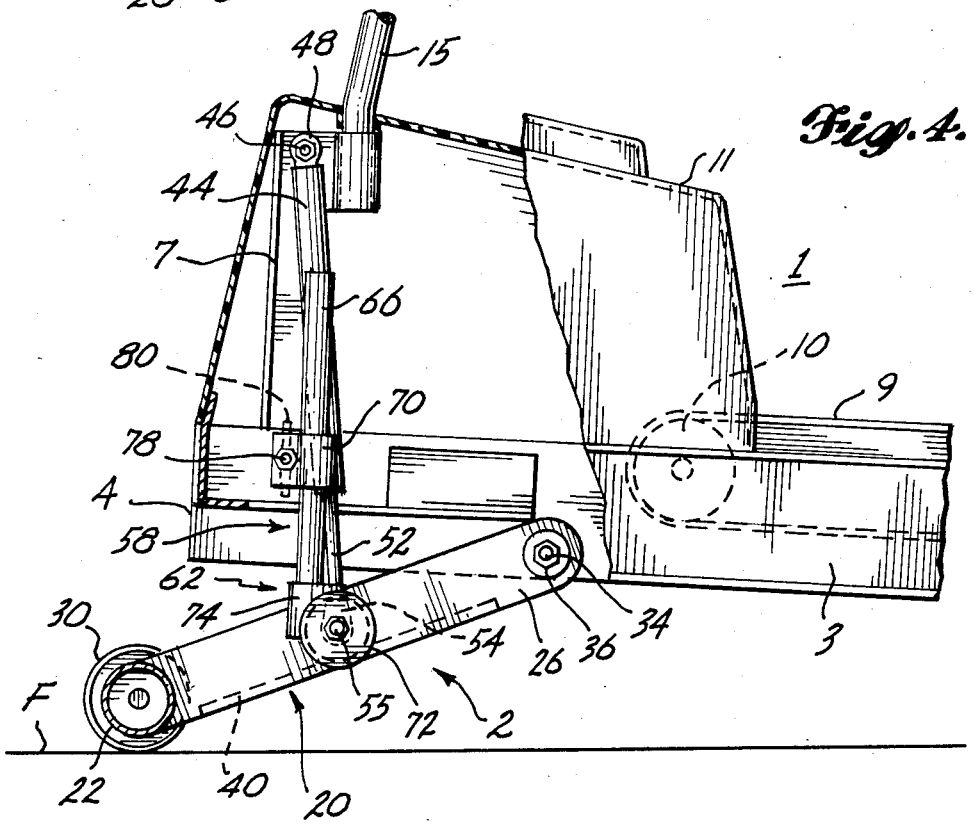
FIG. 4 is a side view, with parts broken, of the system of FIG. 2 in one of its plurality of extended positions.

For swinging movement of the support assembly 20, the upper ends of the arms 24 and 26 are pivotally connected to the side rails 3 and 4, respectively. This pivotal connection is identical for each of the arms and includes a circularly-shaped spacer 32, which positions the arms lightly inward from the side rails 3 and 4, and a pivot pin 34 that passes inwardly sequentially through the side walls of a respective side rail, spacer, and arm to engage with a nut 36. The two pivot pins 34 are axially aligned to define an axis about which the support assembly 20 is moved between the retracted position shown in FIGS. 3 and 5 and a plurality of extended positions, an intermediate one of which is illustrated in FIG. 4. The arms 24 and 26 have flanges 38 and 40 that project outward from and extend along the lower edges of the arms to provide stability when in a plurality of extended positions.

To provide controlled movement of support assembly 20, gas springs 42 and 44 are connected to arms 24 and 26, respectively, and to the upright posts 6 and 7, respectively. The upper ends of gas springs 42 and 44 are pivotally secured to the posts 6 and 7, respectively, by pins 46 that extend inwardly through clearance openings formed in the upper ends of the posts and eyes formed in the cylinder ends gas springs to engage threaded nuts 48. The gas springs 42 and 44 are of conventional spring-less design, having a valved, rod-carrying piston positioned within a gas-containing cylinder. The piston rods 50 and 52 of the gas springs 42 and 44, respectively, are pivotally connected to the arms 24 and 26, respectively, by pivot pins 55 that extend through clearance openings formed in rod ends 54 and formed in central portions of the arms to engage with corresponding nuts 57. By means of these pivotal connections, the gas springs 42 and 44 are free to both pivot and swing as the support assembly 20 is shifted between extended and retracted positions. During this movement, the gas springs exert a substantially constant force against the corresponding pistons, not shown, of rods 50 and 52, and thus also against arms 24 and 26. The operating characteristics of the two springs are selected in relation to the weight of the treadmill so that there is a substantially zero-bias or balanced condition regardless of the position of the elevating system. As a result, the forward end of the treadmill can be substantially effortlessly raised and lowered by the user.

To maintain treadmill 1 in one of an infinite number of elevated positions corresponding to the plurality of extended positions of the support assembly 20, the elevation system 2 includes means for releasably locking the support assembly. While a variety of means may be employed, it is preferred to utilize a pair of slide-tube assemblies 56 and 58 for controlling arms 24 and 26, respectively. The primary components of the slide-tube assemblies are collars 60 and 62, slide-tubes 64 and 66, and clamping sleeves 68 and 70. The collars 60 and 62 are formed with circular body portions 72 that are pivotally connected to central portions of arms 24 and 26, respectively, by the same pivot pins 55 that provide connection to the arms for the piston rods 50 and 52 of the gas springs. Body portions 72 are formed with central clearance openings to receive pins 55. Also, body portions 72 are formed with a circular face that bears against the adjacent surface of arms 24 and 26 to assist in maintaining the orientation of pins 55 transversely to the lengths of arms 24 and 26 and in proper alignment with collars 60 and 62 and rod ends 54 to prevent binding of these members.

Each of the collars 60 and 62 has a cylindrically-shaped socket portion 74 into which the lower ends of the slide-tubes 64 and 66, respectively, are fixedly secured. The slide-tubes 64 and 66 pass through the generally U-shaped clamping sleeves 68 and 70, respectively, which are pivotally connected to the side rails 3 and 4, respectively. As seen best in FIG. 2, the clamping sleeves 68 and 70 are held at a position inwardly of the side rails by cylindrically-shaped spacers 76 and connected to the side rails by pivot bolts 78, which pass through close-fitting holes provided adjacent the side flange portions of the clamping sleeves and through aligned clearance openings provided in the two side walls of the side rails 3 and 4. The pivot bolts 78 have threaded outer ends that receive wing nuts 80.

When the wing nuts 80 are tightened, the clamping sleeves 68 and 70, respectively, are actuated to tightly grip the slide-tubes 64 and 66, respectvely, and, thus, hold the same in their current position, for example, the position shown in FIG. 4. When the wing nuts are loosened, the grip of the clamping sleeves is disengaged and the slide-tubes 64 and 66 easily slide therein. Consistent with the objective of simple, efficient operation, only hand-tightening of the wing nuts is required to securely lock the treadmill 1 in a desired inclined position. The provision of a pivot point at each end of the slide-tubes to accommodate the required simultaneous swinging and pivoting movement of the slide-tubes further enhances the smooth operation of the elevating system.

The present invention has been described and illustrated in relation to its preferred embodiments. One of ordinary skill in the art, after reading the foregoing specification, will be able to affect various changes and substitutions of equivalents without departing from the concepts disclosed herein. It is therefore intended that the invention be limted only by the definition contained in the appended claims and equivalents thereof. 9n The embodiments of the invention in which an exclusive property or privilege is claimed are defined as follows:

1. A system for elevating an exercise treadmill, said treadmill having a frame, said system comprising:

a support assembly having a pair of arms and a roller, said roller being mounted between first ends of said arms for contacting a surface upon which said exercise treadmill is positioned, said arms being pivotally connected at their opposite ends to said frame for swinging movement of said support assembly between a retracted position adjacent said frame and extended positions wherein said roller is positioned downwardly from said frame thereby raising said treadmill to desired elevations;

a pair of self-contained gas springs, one of said gas springs being pivotally connected at its lower end to one of said arms and the other one of said gas springs being pivotally connected at its lower end to the other one of said arms, the upper ends of said gas springs being connected to said frames; and releasable locking means for selectively locking said support assembly relative to the frame at any desired position between the retracted and extended positions of said support assembly.

2. The system of claim 1, wherein said releasable locking means comprises a pair of slide tube assemblies, one of said slide tube assemblies being provided for each of said arms, each of said slide tube assemblies comprising a collar pivotally mounted to said arm, a slide tube connected at its lower end to said collar, and a clamping sleeve disposed about said slide tube and pivotally connected to said frame, said clamping sleeve being selectively operable between a disengaged mode and an engaged mode, in the disengaged mode said slide tube being longitudinally slidable relative to said clamping sleeve, in the engaged mode said clamping sleeve securely clamping said slide tube in fixed position at a location along the length of said slide tube corresponding to the desired position of said support assembly.

3. The system of claim 2, wherein for each of said slide tube assemblies, the clamping sleeve is connected to said frame by a pivot bolt having a nut on a threaded end thereof, said nut being manually actuable to operate said clamping sleeve.

4. The system according to claim 1, wherein said gas springs each exert a substantially constant force against corresponding arms at any desired extended position of said arms.

5. A system for elevating one end of an exercise treadmill relative to a supporting surface, said treadmill including a frame, said frame having first and second side rails lying opposite one another, said first side rail having a first post extending upwards therefrom, said second side rail having a second post extending upwards therefrom, said system comprising:

a first arm having an upper end and a lower end, said upper and end being pivotally mounted on said first side rail for swinging movement of said first arm between a retracted position adjacent said frame and extended positions downwardly and outwardly from said frame to a maximum extended position;

a second arm having an upper end and a lower end, said upper end being pivotally mounted on said second side rail for swinging movement of said second arm between a retracted position adjacent said frame and extended positions downwardly and outwardly from said frame to a maximum extended position;

roller means mounted between the lower ends of said first and second arms and arranged to provide supporting contact with said supporting surface;

a first self-contained gas spring pivotally connected to said first arm and to said first post, said first gas spring extensible to exert force against said first arm;

first releasable locking means for selectively locking said first arm relative to said frame in any selected position between the retracted position and maximum extended position of said second arm;

a second self-contained gas spring pivotally connected to said second arm and to said second post, said second gas spring being extensible to exert force against said second arm; and second releasable locking means for selectively locking said second arm relative to said frame in any selected position between the retracted position and maximum extended position of said second arm.

6. The system of claim 5, wherein said first and second gas springs are connected to said first and second arms by first and second pivot pins, respectively, and wherein:

said first releasable locking means comprises a first slide tube and a first clamping sleeve, said first slide tube being pivotally connected at one end to said first arm by said first pivot pin, said first clamping sleeve being disposed about said first slide tube, pivotally connected to said first side rail of said frame and securely clamping said first slide tube when locking said first arm relative to said frame; and, said second releasable locking means comprises a second slide tube and a second clamping sleeve, said second slide tube being pivotally connected at one end to said second arm by said second pivot pin, said second clamping sleeve being disposed about said second slide tube, pivotally connected to said second side rail of said frame and securely clamping said first slide tube when locking said first arm relative to said frame.

7. The system of claim 6, wherein:

said first clamping sleeve is connected to said first rail by a first pivot bolt engaging manually operable actuating means to actuate said first clamping sleeve; and said second clamping sleeve is connected to said second rail by a second pivot bolt engaging manually operable actuating means to actuate said second clamping sleeve.

8. The system of claim 7, wherein said first and second arms, said first and second gas springs, said first and second slide tubes, and said first and second clamping sleeves are each mounted inwardly from said first and second side rails.

9. The system of claim 5, wherein said first and second gas springs exert a substantially constant force against said first and second arms, respectively, at any extended position of said first and second arms thereby facilitating the movement of the first and second arms between retracted and extended positions.

* * * * *